United States Patent [19]

Bartolles

[11] Patent Number: 5,058,482

[45] Date of Patent: Oct. 22, 1991

[54] BLOCKING DEVICE FOR THE BREECHBLOCK IN A GUN

[75] Inventor: Rolf Bartolles, Korschenbroich, Fed. Rep. of Germany

[73] Assignee: Rheinmetall GmbH, Düsseldorf, Fed. Rep. of Germany

[21] Appl. No.: 553,320

[22] Filed: Jul. 17, 1990

[30] Foreign Application Priority Data

Jul. 18, 1989 [DE] Fed. Rep. of Germany ..... 3923714

[51] Int. Cl.[5] ..... F41A 3/74

[52] U.S. Cl. ..... 89/26; 89/24

[58] Field of Search ..... 89/17, 22, 24, 26

[56] References Cited

U.S. PATENT DOCUMENTS 43,820 8/1864 Krupp ..... 89/24

3,420,139 1/1969 Bartels ..... 89/17

*Primary Examiner*—Stephen C. Bentley

*Attorney, Agent, or Firm*—Spencer & Frank

[57] ABSTRACT

A blocking device for blocking the closing movement of a wedge-type breechblock of a gun if an obturating ring is missing. The blocking device includes a detector which is urged toward a recess in the gun barrel base ring and which enters the recess if the recess is not occupied by an obturating ring. In order to avoid damage to the sealing system of the base ring during the blocking process, the blocking device is configured as a synchronous mechanism so that, if the detector moves into the recess in the absence of an obturating ring, a blocking member simultaneously moves in the opposite direction and enters a recess in the breech ring of the gun. In one embodiment, the synchronism of the blocking device is produced by a gear which meshes with toothed regions on the detector and of the blocking member. In another embodiment, the synchronism is produced by a dual level member which extends into recesses in the detector and the blocking member. Advantageously, the recess which is already provided in the breech ring can be utilized for blocking the wedge-type breechblock and for releasing the blocking device.

10 Claims, 3 Drawing Sheets

90°
d
s

BLOCKING DEVICE FOR THE BREECHBLOCK IN A GUN

CROSS REFERENCE TO RELATED APPLICATION

This application claims the priority of Application Serial Number P 29 23 714.1, filed on July 18, 1989 in the Federal Republic of Germany, the subject matter of which is incorporated herein by reference.

BACKGROUND OF THE INVENTION

The present invention relates to a blocking device for a wedge-type breechblock in a gun, and more particularly to a blocking device of the type which is arranged parallel to the bore axis of the gun and which includes a detector. A recess is provided in a base ring at the base of the gun barrel to accommodate an obturating ring, and the detector engages the recess under the force of a spring if the obturating ring is absent from the recess.

Such a blocking device is disclosed in U.S. Pat. No. 3,420,139. In such a blocking device, if the obturating ring is missing, the detector drops into the recess for the obturating ring and interrupts the locking process of the breechblock.

The kinetic energy of the closing breechblock, which must be decelerated at once, may cause damage to the sealing system of the base ring, particularly at the contact faces of the obturating ring. Repair of such damages consumes time and causes a considerable amount of installation and adjustment expenditures.

SUMMARY OF THE INVENTION

It is an object of the present invention to make available a blocking device which blocks the closing movement of the breechblock wedge in the absence of an obturating ring in such a manner that damage to the sealing system of the base ring at the breech end of the gun barrel is avoided.

This is accomplished by providing a blocking device which is configured as a synchronous device which includes a blocking member that, in the absence of an obturating ring, moves simultaneously with the motion of the detector in the direction of the base ring but in the opposite direction, so as to drop into a recess disposed in the breech ring opposite the base ring.

The present invention makes it possible to interrupt the closing movement of a breechblock and prevent further closing if the obturating ring has not been inserted, no longer on the frontal face of the obturating ring which is sensitive to malfunctions, but, without endangering the sealing system, on the oppositely disposed rear side at the breech ring. The blocking device according to the present invention is able to determine from the sealing system in the conventional manner whether an obturating ring has been inserted into the base ring of the gun barrel or not. If no obturating ring is present, a blocking member is introduced into a recess in the breech ring, so as to block the breech-block wedge, at the same time as the detector slides into the recess in the base ring provided for the obturating ring.

Compared to the conventional blocking device, which always had to consider the close confines of the recess provided for the obturating ring, the blocking member of the device according to the invention can be made significantly more stable, and can therefore be employed frequently and reliably without any damage arising from its use.

The present invention avoids expensive and time consuming repair work in the region of the sealing system, particularly work involved with the considerable damage that may be caused by the lack of or insufficient repair of the sealing system.

In order to realize simultaneous but oppositely directed movement of the detector and the blocking member, the blocking device is advantageously configured as a synchronous device. The present invention permits the use of two different synchronous devices which, however, are each of simple construction. According to one preferred embodiment, the synchronism is realized by two toothed rods or toothed regions meshing with a gear, while in the other embodiment a dual lever member mounted in the center of the device controls the synchronism.

In both embodiments, a diametral arrangement of, for example, toothed rods, compression springs, stops, and so forth within a cylindrical housing produces a space saving effect, so that the blocking device according to the invention can be used to replace a conventional blocking device without any changes in the installation conditions at the breechblock wedge.

In both embodiments, the breechblock may be blocked directly in the open breechblock position before the breechblock closing movement starts, or a beginning closing movement of the breechblock wedge may be interrupted in a known manner. In both cases, a recess provided in the breech ring for the installation and removal of the blocking device can be utilized as a stop for the blocking member.

DESCRIPTION OF THE PREFERRED EMBODIMENTS

Figure 1:
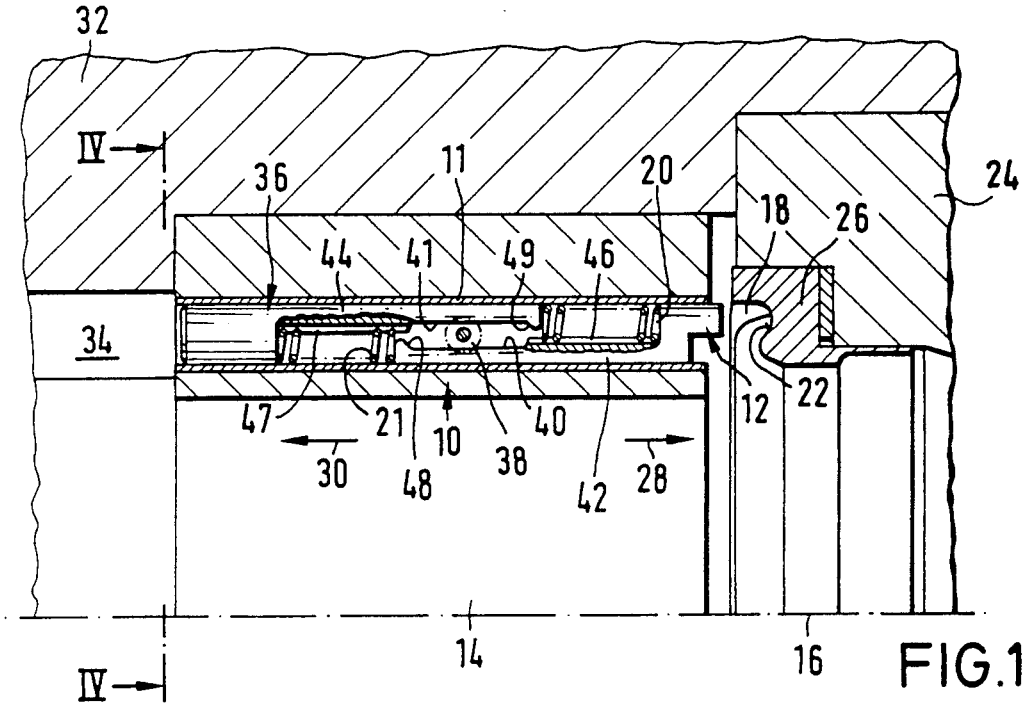
FIG. 1 is a sectional view, seen along line I—I of FIG. 4, of the end of a gun barrel with an obturating ring inserted into a recess in the base ring and with a blocking device in accordance with a first embodiment of the present invention disposed in the breechblock wedge but not inserted into a recess in the breech ring, the blocking device being provided with a synchronous gear mechanism.
Figure 2:
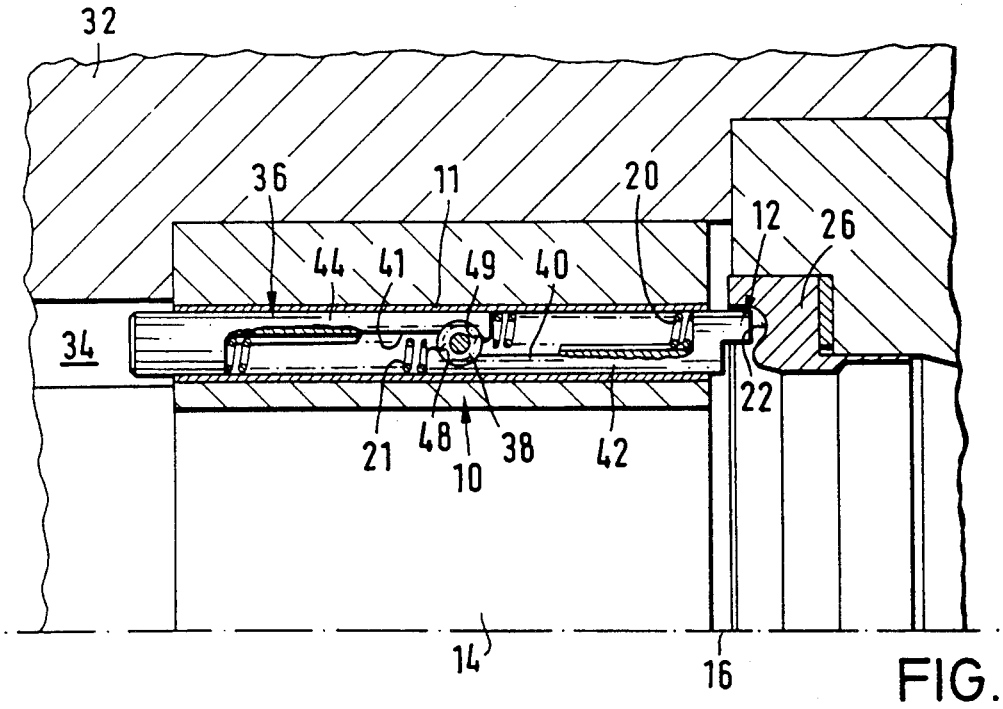
FIG. 2 is a sectional view showing the arrangement depicted in FIG. 1 without the obturating ring, and with the blocking device inserted into the recess in the breech ring.

FIGS. 1 and 2 illustrate the rear end of a gun barrel breech area or base 24 and a base ring 26 fastened thereto so as to accommodate in a known manner an obturating ring 18. A wedge-type breechblock mechanism 14 is guided in the breech ring 32 of the gun barrel. A blocking device 10 in accordance with the first embodiment of the invention is disposed in breechblock mechanism 14 parallel to the bore axis 16 of the gun barrel.

Blocking device 10 includes a device housing 11 and a detector 12 which, if obturating ring !8 is absent from recess 22 in base ring 26, moves in direction 28 under the force of a spring 20 into the recess 22, which is provided to accommodate obturating ring 18. When detector 12 moves into recess 22, a blocking member 36 simultaneously moves in the opposite direction 30, with the blocking member 36 dropping into a recess 34 provided in breech ring 32 during the blocking process. As will be discussed in more detail below, blocking device 10 is configured as a synchronous mechanism, meaning that the detector 12 and the blocking member 36 are linked so as to move in unison but in opposite directions. Thus the sensing movement of detector 12 in the direction 28 is matched by a corresponding linear movement of blocking member 36 in direction 30 if obturating ring 18 is missing.

FIG. 1 shows that, if an obturating ring 18 is inserted into base ring 26, detector 12 prevents blocking member 36, which is linked to detector 12 in a manner which will be discussed, from entering recess 34 of breech ring 32. However, as is shown in FIG. 2 the absence of an obturating ring 18 causes blocking member 36 to take on the blocking position in breech ring 32 as a result of the sensing process.

Figures 3, 4, 5, 6:
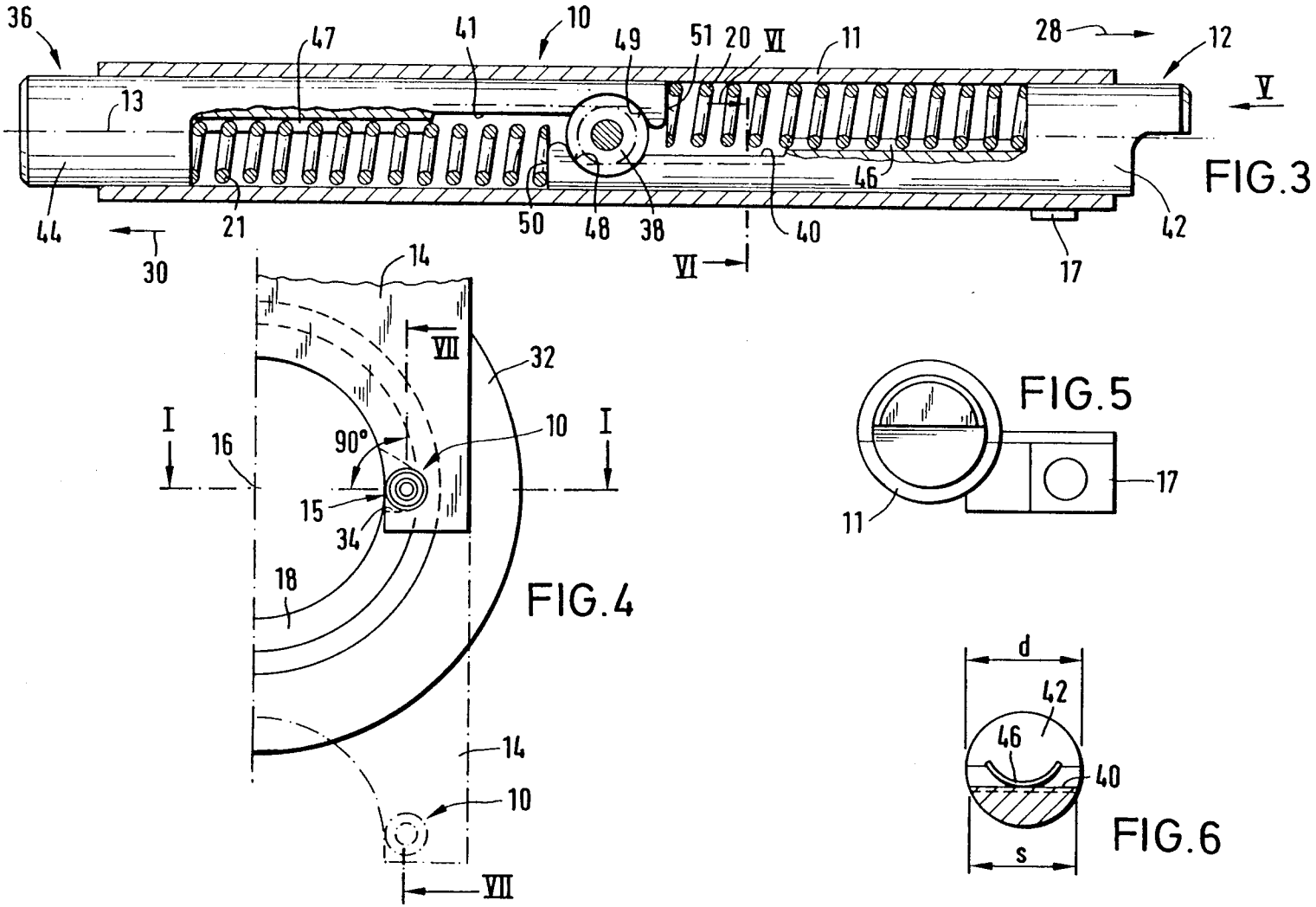
FIG. 3 is an enlarged longitudinal sectional view of the blocking device of the first embodiment, which is provided with a synchronous gear mechanism.
FIG. 4 is a sectional view along line IV—IV of FIG. 1.
FIG. 5 is a view in direction V of FIG. 3.
FIG. 6 is a sectional view seen along line VI—VI of FIG. 3.

For synchronous operation, the blocking device 10 includes a linkage arrangement which is best shown in FIG. 3. The linkage arrangement includes a gear 38 mounted in the middle of housing 11 transversely to housing axis 13. Gear 38 meshes with oppositely disposed toothed regions 40 and 41 on detector 12 and blocking member 36, respectively. Due to the facing arrangement of the toothed regions 40 and 41 at gear 38, if detector 12 is displaced in direction 28, blocking member 36 undergoes a reverse movement in the opposite direction 30.

Except for its shape in the tip region where it is adapted to recess 22 for the sensing process, detector 12 is configured as a mirror image of blocking member 36.

Toothed region 40 of detector !2 and toothed region 41 of blocking member 36 each form a face oriented in the displacement directions 28 and 30. Detector 12 and blocking member 36 are given the shape of pins 42 and 44. The width of the faces of toothed regions 40 and 41 is determined by the chord length s (FIG. 6) of pins 42 and 44, whose outer diameters d (FIG. 6) are identical. The width of the faces of toothed regions 40 and 41 is almost as great as their diameters d not only to ensure stable meshing between toothed regions 40 and 41 and gear 38, which is relatively thick, but also to secure the detector 12 and blocking members 36 against rotation within housing 11.

The lengths of the respective toothed regions 40 and 41 are determined by the sensing stroke of detector 12 and the blocking stroke of blocking member 36. The length of toothed region 40 is limited on one side by a spring guide 46 and on the other side by a stop 48 at the pin end. Similarly, toothed region 41 extends from a spring guide 47 to a stop 49 at the end of pin 44. When pin 44 (that is, blocking member 36) performs its blocking function, stops 48 and 49 lie diametrally against gear 38.

The end faces 50 and 51 of pins 42 and 44 provide supporting faces for springs 20 and 21, which are held by the spring guides 46 and 47. This permits a space saving arrangement of the springs.

Pins 42 and 44 attain their full cross sections behind spring guides 46 and 47, so that they are securely guided on one side by gear 38 and on the other side in housing 11. Housing 11 is provided with a mount 17 (FIG. 5) on its exterior so that blocking device 10 can be fastened on an end face of breechblock wedge 14 by means of screws (not shown).

FIG. 4 shows that blocking device 10 is disposed, for example, at the lower end of a drop or lift wedge-type breechblock 14. In contrast to the closed position of breechblock 14 (shown in dot-dash lines), in the open position of breechblock 14 (shown in solid lines) blocking device 10 is located at a position 15. In this position, the axis of blocking device 10 is parallel to bore axis 16 (which is perpendicular to the drawing in FIG. 4 at the place marked by the lead-line to reference number 16, and should not be confused with the dot-dash center line shown in the drawings), and a plane containing both the bore axis 16 and the axis of blocking device 10 is disposed at right angles to a plain containing the axis of blocking device 10 as breechblock 14 moves between the open and closed positions. If no obturating ring 18 is present, breechblock 14 can be secured immediately in the open position by the dropping of blocking member 36 into the breech ring 32. Blocking member 36 enters the recess 34 provided for the installation and removal of blocking device 10 and possibly already existing in breech ring 32 (FIG. 4). Recess 34 is connected with the exterior region of breech ring 32 so that blocking member 36 can be released in a simple manner by pressing in, for example, a rod (not shown).

Figure 7:
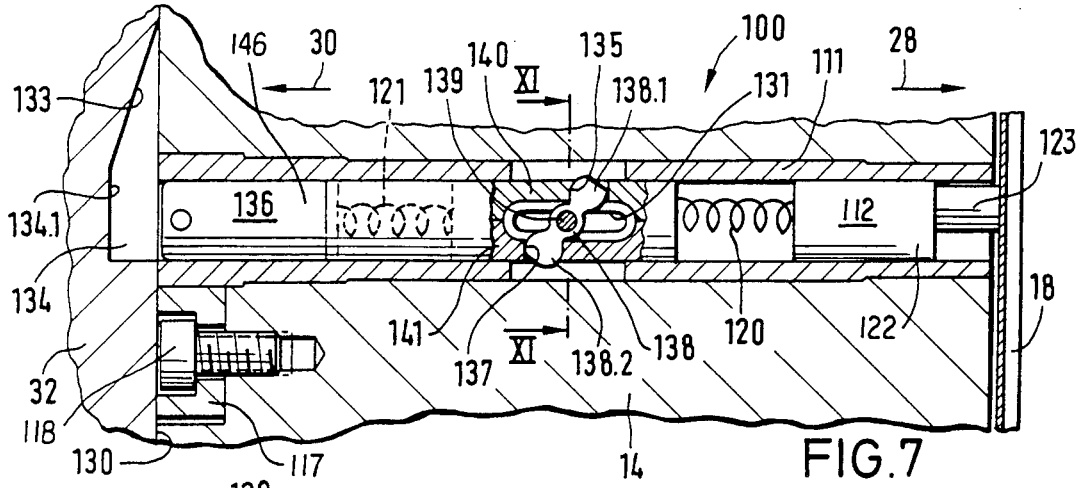
FIG. 7 is a sectional view, taken along a line corresponding to VII—VII in FIG. 4, of a blocking device in accordance with a second embodiment of the present invention, the second embodiment including a synchronous mechanism equipped with a dual lever member.
Figure 10:
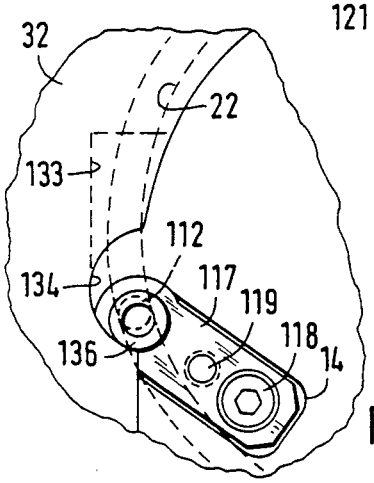
FIG. 10 is a view in direction X of FIG. 8.
Figure 11:
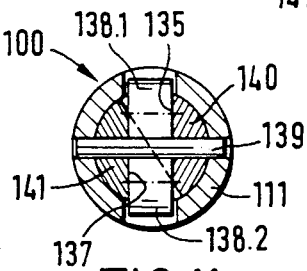
FIG. 11 is a sectional view along line XI—XI of FIG. 7.
Figure 12:
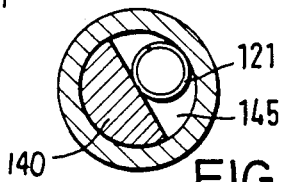
FIG. 12 is a sectional view along line XII—XII of FIG. 8.
Figure 13:
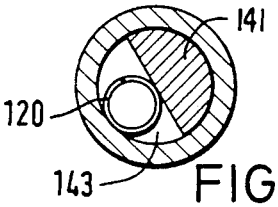
FIG. 13 is a sectional view along line XIII—XIII of FIG. 8.

FIGS. 7 through 13 illustrate a blocking device 100 in accordance with a second embodiment with the present invention. With primary reference to FIG. 7, blocking device 100 includes a detector 112 and a blocking member 136 which are slidably disposed within a housing 111. Blocking member 136 includes an outer portion 146 which is circular in cross-section and a leg 140 which is semicircular in cross-section (also see FIG. 12). Detector 112 includes a portion 122 which is circular in cross-section and an inner leg 141 which is semicircular in cross-section (also see FIG. 13). The semicircular legs 140 and 141 are positioned so that they are diametrically opposite one another, as shown in FIG. 11. A free space 143 (FIG. 13) exists between the end of leg 140 and portion 122 of detector 112, and a compression spring 120 is disposed in free space 140. Similarly, a free space 145 (see FIG. 12) exists between the end of leg 141 and portion 146 of blocking member 136. A spring 121 is disposed in free space 145 (see FIG. 12). Like blocking device 10 of the first embodiment, blocking device 100 is configured as a synchronous mechanism. Although springs 120 and 121 urge detector 112 and blocking member 136 apart, they are operationally connected by a linkage mechanism so as to move in unison but in opposite directions. If tip 123 encounters obturating ring 18, as shown in FIG. 7, the linkage arrangement retains blocking member 136 inside housing 111 despite the force of springs 120 and 121. On the other hand if obturating ring 18 is absent—the state shown in FIG. 8—tip 123 is free to move outward and the linkage arrangement simultaneously permits blocking member 136 to move outward.

The linkage arrangement of blocking device 100 includes a centrally mounted dual lever member 138 which is operatively connected by a form-fitting arrangement to legs 140 and 141, which are diametrically oppositely disposed. Lever member 138 has a lever arm 138.1 which is generally spherical in shape and which is disposed in a corresponding recess 135 in arm 140. Lever member 138 also has a lever arm 138.2 which is generally spherical in shape and which is disposed in a corresponding recess 137 (also see FIG. 9) in leg 141.

Lever member 138 is pivotably mounted by a bearing pin 139, which extends through slots 131 (see FIGS. 7 and 9) in the legs 140 and 141. Bearing pin 139 cooperates with slots 131 to secure detector 112 and blocking member 136 against rotation and to limit their maximum stroke.

On the side of the breech ring 32, housing 111 is connected to breechblock 14 by a mount 117 and, for example, a screw 118 and a pin 119 (see FIG. 10). The external dimensions of housing 111 may be such that it can be used to replace conventional blocking devices as described above and already in use in guns.

Figure 8:
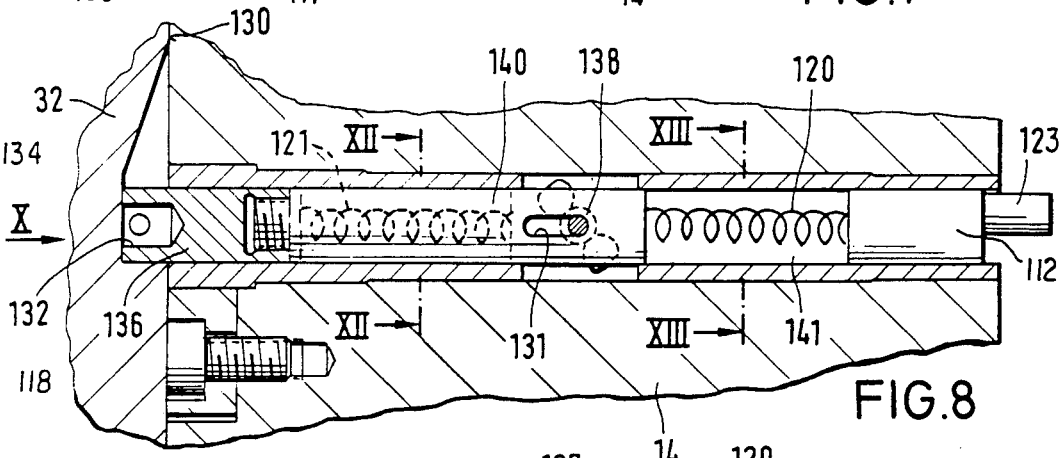
FIG. 8 is sectional view of the blocking device of FIG. 7 in a position in which the blocking member has entered a recess in the breech ring.
Figure 9:
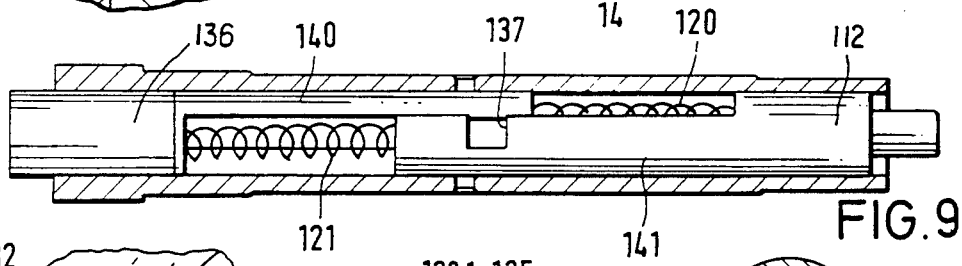
FIG. 9 is a sectional view of the blocking device as seen from its bottom side with respect to FIG. 8.

As indicated in U.S. Pat. No. 3,420,139, the conventional blocking devices cannot be secured with the breechblock open, but interrupt the movement of the breechblock wedge after this movement has already started if no obturating ring 18 is present. In order for blocking member 136 to come fully in contact in such a case, the base face 134.1 of recess 134 in breech ring 32 is connected with a transition region 133 extending obliquely to breechblock guide surface 130 of breech ring 32. Such a transition 133 is shown in FIGS. 7, 8 and 10, and causes blocking device 100 to be automatically released in an advantageous manner when the breechblock wedge is opened. A transition region 133 may also be employed with the embodiment of FIGS. 1–6.

FIG. 8 shows that blocking member 136 contacts the lower region of recess 134, while detector 112 is extended to engage in recess 22 of base ring 26 (FIG. 1). In order to moderate the blocking process and avoid possible deformations of blocking member 136, the latter may be provided with a hollow bore 132 or may be set off in the blocking region in a manner not shown.

It will be understood that the above description of the present invention is susceptible to various modifications, changes, and adaptations, and the same are intended to be comprehended within the meaning and range of equivalents of the appended claims.

What I claim is:

1. A blocking device, for use with a gun which includes a gun barrel with a base and a bore axis, a base ring at the base of the gun barrel, the base ring having a recess to accommodate an obturating ring, a breech ring having a recess opposite the base ring, and a wedge-type breechblock which is movable adjacent the base ring and the breech ring and which carries the blocking device, to block the wedge-type breechblock if the obturating ring is absent from the recess in the base ring, said blocking device being disposed parallel to the bore axis of the gun barrel and comprising:

a detector;

a spring to urge the detector toward the base ring, the spring moving the detector so that the detector enters the recess in the base ring if the recess in the base ring is not occupied by an obturating ring;

a blocking member; and synchronous movement means for moving the blocking member simultaneously with the movement of the detector and in a direction opposite to the movement of the detector if the recess in the base ring is not occupied by an obturating ring, the blocking member entering the recess in the breech ring.

2. The blocking device of claim 1, further comprising a housing, and wherein the detector and the blocking member have oppositely disposed toothed regions, and wherein the synchronous movement means comprises a gear which is mounted in the housing and which meshes with the toothed regions.

3. The blocking device of claim 2, wherein the detector and the blocking member are movable in respective displacement directions, wherein at least a portion of the detector is configured as a pin which is oriented in the displacement direction of the detector, the toothed region of the detector being provided on the at least a portion of the detector that is configured as a pin, and wherein at least a portion of the blocking member is configured as a pin which is oriented in the displacement direction of the blocking member, the toothed region of the blocking member being provided on the at least a portion of the blocking member that is configured as a pin.

4. The blocking device of claim 4, wherein the detector has a spring guide and an inner end, the toothed region of the detector being disposed between the inner end of the detector and the spring guide of the detector, wherein the blocking member has a spring guide and an inner end, the toothed region of the blocking member being disposed between the inner end of the blocking member and the spring guide of the blocking member, and wherein the inner ends of the detector and the blocking member lie against the gear in a diametrically opposed relationship if the detector enters the recess in the base ring and the blocking member enters the recess in the breech ring.

5. The blocking device of claim 4, wherein the synchronous movement means further comprises another spring, one of the spring and the another spring extending between the spring guide of the detector and the inner end of the blocking member and the other of the spring and the another spring extending between the spring guide of the blocking member and the inner end of the detector.

6. The blocking device of claim 1, further comprising a housing, wherein the detector has a leg with a semicircular cross section, wherein the blocking member has a leg with a semicircular cross section, and wherein the synchronous movement means comprises a dual lever member mounted centrally in the housing, the dual leaver member being operatively connected to the legs of the detector and the blocking member.

7. The blocking device of claim 6, wherein the dual lever member has a first lever arm with a generally circular portion and a second lever arm with generally circular portion, the leg of the detector having a recess in which the first lever arm is disposed and the leg of the blocking member having a recess in which the second lever arm is disposed.

8. The blocking device of claim 6, wherein the synchronous movement means further comprises a bearing pin, the dual lever member being mounted on the bearing pin, and wherein the legs of the detector and the blocking member have slots through which the bearing pin extends to provide guidance relatively to the bearing pin.

9. The blocking device of claim 6, wherein the housing has a wall, wherein a free space exists in the housing between a portion of the leg of the detector and the housing wall, wherein a free space exists in the housing between a portion of the leg of the blocking member and the housing wall, the free spaces being on opposite sides of the dual lever member, wherein the spring is a compression spring, and wherein the synchronous movement means further comprises another compression spring, one of the spring and the another spring being disposed in the free space between a portion of the leg of the detector and the housing wall and extending between the detector and the blocking member, and the other of the spring and the another spring being disposed in the free space between a portion of the leg of the blocking member and the housing wall and extending between the detector and the blocking member.

10. The blocking member of claim 1, wherein the breech ring has a breechblock guide surface facing the breechblock, and wherein the recess in the breech ring has a base face and a transitional region which extends transverse to the breechblock guide surface.

* * * * *